US010801084B2

(12) United States Patent
Mizutani et al.

(10) Patent No.: US 10,801,084 B2
(45) Date of Patent: Oct. 13, 2020

(54) MATERIAL FOR COLD ROLLED STAINLESS STEEL SHEETS, METHOD FOR MANUFACTURING THE SAME, AND COLD ROLLED STEEL SHEET

(71) Applicant: JFE STEEL CORPORATION, Tokyo (JP)

(72) Inventors: Akito Mizutani, Tokyo (JP); Masataka Yoshino, Tokyo (JP); Mitsuyuki Fujisawa, Tokyo (JP); Chikara Kami, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 181 days.

(21) Appl. No.: 15/737,045

(22) PCT Filed: Jul. 2, 2015

(86) PCT No.: PCT/JP2015/003340
§ 371 (c)(1),
(2) Date: Dec. 15, 2017

(87) PCT Pub. No.: WO2017/002148
PCT Pub. Date: Jan. 5, 2017

(65) Prior Publication Data

US 2018/0363083 A1 Dec. 20, 2018

(51) Int. Cl.
*C21D 8/02* (2006.01)
*C21D 9/46* (2006.01)
(Continued)

(52) U.S. Cl.
CPC ..... *C21D 8/0263* (2013.01); *C21D 6/002* (2013.01); *C21D 8/0226* (2013.01);
(Continued)

(58) Field of Classification Search
None
See application file for complete search history.

(56) References Cited

U.S. PATENT DOCUMENTS 3,653,981 A * 4/1972 Watanabe ..... C21D 6/002 148/610
5,851,316 A 12/1998 Yazawa et al.
(Continued)

FOREIGN PATENT DOCUMENTS

CN 101586215 A 11/2009
CN 103305766 A 9/2013
(Continued)

OTHER PUBLICATIONS

Espacenet Machine Translation of JPH09111354 (Year: 2019).*
(Continued)

*Primary Examiner* — Coris Fung
*Assistant Examiner* — Christopher Douglas Moody
(74) *Attorney, Agent, or Firm* — RatnerPrestia

(57) ABSTRACT

Provided are a material for cold rolled stainless steel sheets having sufficient corrosion resistance, excellent surface quality, excellent formability, and excellent ridging resistance; a method for manufacturing the same; and a cold rolled steel sheet. A material for cold rolled stainless steel sheets according to the present invention contains C: 0.005% to 0.025%, Si: 0.02% to 0.50%, Mn: 0.55% to 1.0%, P: 0.040% or less, S: 0.01% or less, Cr: 15.5% to 18.0%, Ni: 0.01% to 1.0%, Al: 0.001% to 0.10%, and N: 0.005% to 0.025% on a mass basis, the remainder being Fe and inevitable impurities, and has a metallographic structure containing 5% to 20% of a martensite phase in terms of volume fraction, the remainder being a ferrite phase.

12 Claims, 1 Drawing Sheet

(51) Int. Cl.

| | |
|---|---|
| ***C22C 38/54*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/52*** | (2006.01) |
| ***C21D 6/00*** | (2006.01) |
| ***C22C 38/40*** | (2006.01) |

(52) U.S. Cl.

CPC ..... *C21D 8/0236* (2013.01); *C21D 9/46* (2013.01); *C22C 38/00* (2013.01); *C22C 38/001* (2013.01); *C22C 38/002* (2013.01); *C22C 38/004* (2013.01); *C22C 38/005* (2013.01); *C22C 38/02* (2013.01); *C22C 38/04* (2013.01); *C22C 38/06* (2013.01); *C22C 38/40* (2013.01); *C22C 38/42* (2013.01); *C22C 38/44* (2013.01); *C22C 38/46* (2013.01); *C22C 38/48* (2013.01); *C22C 38/50* (2013.01); *C22C 38/52* (2013.01); *C22C 38/54* (2013.01); *C21D 2211/005* (2013.01); *C21D 2211/008* (2013.01)

(56) References Cited

U.S. PATENT DOCUMENTS

| | | | | |
|---|---|---|---|---|
| 2004/0226634 | A1* | 11/2004 | Hirasawa ..... | C21D 6/002 148/609 |
| 2004/0244877 | A1 | 12/2004 | Yokoi et al. | |
| 2013/0186527 | A1* | 7/2013 | Bradley ..... | C21D 6/02 148/624 |

FOREIGN PATENT DOCUMENTS

| | | | | |
|---|---|---|---|---|
| CN | 103608479 | A | | 2/2014 |
| EP | 2722411 | A1 | | 4/2014 |
| EP | 2947170 | A1 | | 11/2015 |
| JP | S60238456 | A | | 11/1985 |
| JP | 0471878 | A | | 3/1992 |
| JP | 09111354 | A | | 4/1997 |
| JP | H1036911 | A | | 2/1998 |
| JP | 10121205 | A | | 5/1998 |
| JP | 2001098328 | A | | 4/2001 |
| JP | 2001107149 | A | | 4/2001 |
| JP | 2009275268 | A | | 11/2009 |
| JP | 2010047822 | A | | 3/2010 |
| JP | WO2014045542 | | * | 3/2014 |
| JP | 2014045542 | A1 | | 8/2016 |
| TW | 236603 | A1 | | 12/2004 |
| TW | 201444985 | A | | 12/2014 |

OTHER PUBLICATIONS

Espacenet Machine Translation of JPWO2014045542 (Year: 2019).*

International Search Report and Written Opinion for International Application No. PCT/JP2015/003340, dated Oct. 6, 2015—4 Pages.

Chinese Office Action for Chinese Application No. 201580081304.8, dated Oct. 23, 2018, with Concise Statement of Search Report—11 pages.

Extended European Search Report for European Application No. 15 897 075.6, dated Jun. 1, 2018, 11 pages.

Taiwan Office Action for Taiwan Application No. 104122005, dated Jan. 13, 2016, with Concise Statement of Relevance of Office Action, 4 pages.

Korean Office Action for Korean Application No. 10-2017-7036668, dated Mar. 15, 2019, with Concise Statement of Relevance of Office Action, 6 pages.

* cited by examiner

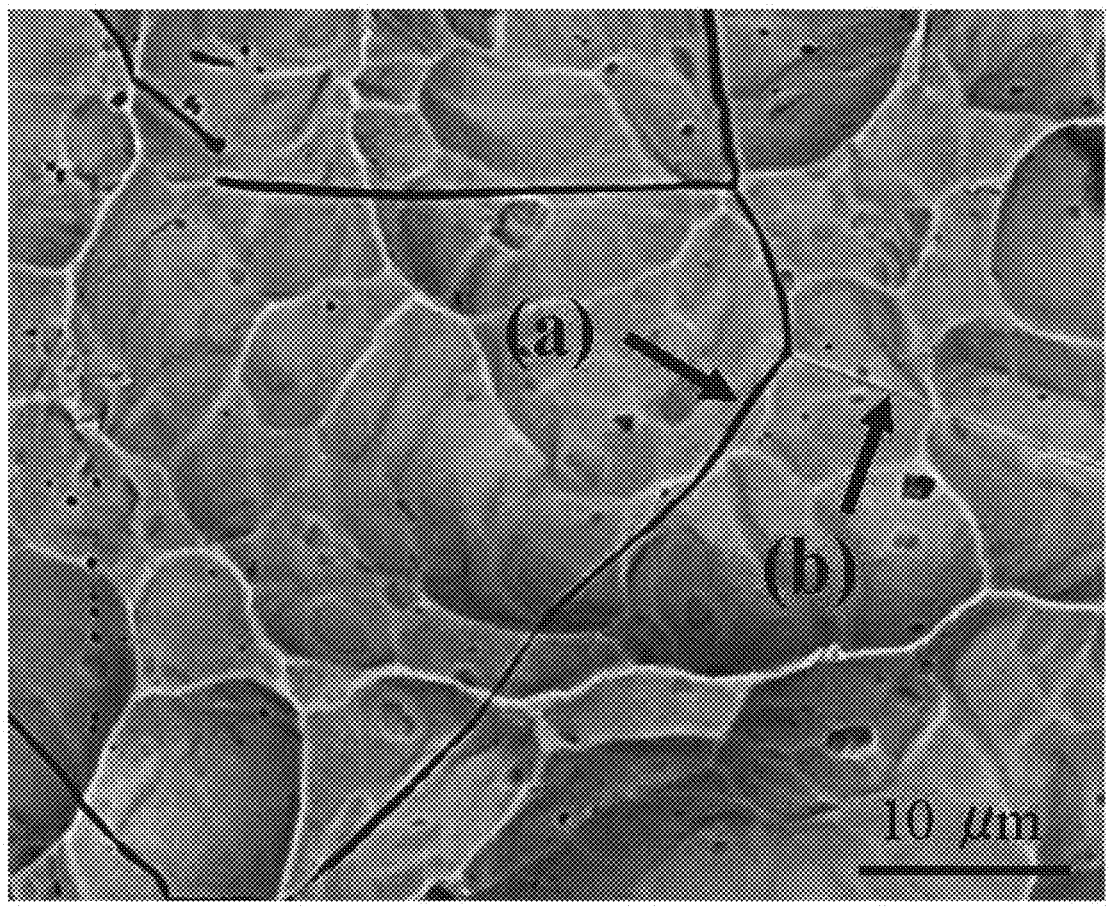
(a)
(b)
10 μm

MATERIAL FOR COLD ROLLED STAINLESS STEEL SHEETS, METHOD FOR MANUFACTURING THE SAME, AND COLD ROLLED STEEL SHEET

CROSS REFERENCE TO RELATED APPLICATIONS

This is the U.S. National Phase application of PCT/JP2015/003340, filed Jul. 2, 2015, the disclosure of this application being incorporated herein by reference in its entirety for all purposes.

TECHNICAL FIELD OF THE INVENTION

The present invention relates to a material for cold rolled stainless steel sheets having sufficient corrosion resistance, excellent surface quality, excellent formability, and excellent ridging resistance; a method for manufacturing the same; and a cold rolled steel sheet.

BACKGROUND OF THE INVENTION

Ferritic stainless steels (steel sheets) are excellent in cost efficiency and corrosion resistance and therefore are used in various applications such as building materials, home appliances, and kitchen tools. In recent years, the range of applications thereof has been further expanding. In order to meet these applications, the ferritic stainless steels are required to have not only corrosion resistance but also excellent surface quality, sufficient formability (high elongation) so as to be formed into a predetermined shape, and excellent ridging resistance.

Among the ferritic stainless steels, SUS430, which contains 16% to 18% by mass Cr, has an excellent balance between the above-mentioned characteristics and price and therefore are used in a wide range as general-purpose steels.

In the process of manufacturing SUS430, a hot rolled sheet is generally annealed by batch annealing (box annealing). Batch annealing is a process for annealing a hot rolled coil in a box furnace and needs several days to about one week including duration from heating to cooling. Thus, batch annealing has significantly lower productivity as compared to continuous annealing, which is widely used a process for annealing a steel sheet at present. Furthermore, in batch annealing, although the recovery of a metallographic structure proceeds, recrystallization does not sufficiently occur; hence, there is a problem in that a colony (ferrite colony) of ferrite phases, supposed to be a cause of ridging, having the same orientation is likely to remain and ridging resistance is poor.

The reason why continuous annealing is not used to anneal a hot rolled sheet of SUS430 is that in continuous annealing, an annealing effect is likely to be insufficient. In usual, the hot rolled sheet of SUS430 is annealed at about 800° C., which is in a ferrite single-phase temperature range. In batch annealing, an annealing temperature is held for several hours or more and therefore recrystallization or grain growth proceeds sufficiently; hence, a desired annealing effect can be obtained. However, in continuously annealing, the holding time at an annealing temperature is short, a few seconds to a few minutes, and therefore the destruction of a hot rolled microstructure by recrystallization or grain growth does not sufficiently proceed during about 800° C. annealing, which is the same as batch annealing. In this case, a colony (a ferrite colony) of ferrite phases, supposed to be a cause of ridging, having the same orientation is likely to remain and ridging resistance decreases significantly.

In order to cope with the above problem, Patent Literature 1 discloses a method for manufacturing a ferritic stainless steel sheet excellent in ridging resistance in such a manner that a hot rolled sheet of steel containing C: 0.15% or less and Cr: 13% to 25% on a mass basis is annealed for 10 minutes or less in a 930° C. to 990° C. temperature range in which an austenite phase and a ferrite phase are present and is cooled at a rate higher than or equal to that of air cooling so as to have a ferrite phase microstructure containing a martensite phase and the hot rolled sheet having the microstructure is cold rolled at a rolling reduction of 30% or more and is then annealed.

The method disclosed in Patent Literature 1 is superior in productivity to batch annealing, because the hot rolled sheet is annealed in a continuous annealing line, and has an advantage that ridging resistance can be increased in such a manner that a ferrite colony is efficiently destroyed by performing cold rolling in such a state that a hard martensite phase is contained. However, in the method disclosed in Patent Literature 1, there is a problem in that the surface gloss of a cold rolled steel sheet obtained from a sheet obtained by pickling the annealed hot rolled sheet is significantly deteriorated. Furthermore, there is a problem in that a cold rolled steel sheet manufactured by the method disclosed in Patent Literature 1 is poor in formability.

That is, a cold rolled SUS430 stainless steel sheet (cold rolled stainless steel sheet material) having sufficient corrosion resistance, excellent surface quality, excellent formability, and excellent ridging resistance has not been obtained.

CITATION LIST

Patent Literature

PTL 1: Japanese Examined Patent Application Publication No. 47-1878

SUMMARY OF THE INVENTION

Aspects of the present invention solve the above problems and are intended to provide a material for cold rolled SUS430 stainless steel sheets having sufficient corrosion resistance, excellent surface quality, excellent formability, and excellent ridging resistance; a method for manufacturing the same; and a cold rolled steel sheet.

In accordance with aspects of the present invention, the term "sufficient corrosion resistance" means that in the case where a steel sheet of which a surface is polish-finished with #600 emery paper and of which an end surface portion is then sealed is subjected to a cyclic salt spray test (a test in which (salt spraying (35° C., 5% by mass NaCl, spraying for 2 hr), drying (60° C., a relative humidity of 40%, 4 hr), and then wetting (50° C., a relative humidity of 95% or higher, 2 hr) are performed in one cycle) specified in JIS H 8502 for eight cycles, the rusting area fraction (=rusting area/total area of steel sheet×100 [%]) of the steel sheet surface is 25% or less.

The term "excellent surface quality" means that the arithmetic average roughness Ra measured perpendicularly to a rolling direction in accordance with JIS B 0601-2001 is 0.03 μm or less.

The term "excellent formability" means that a JIS 13B specimen taken in a direction perpendicular to a rolling direction has a elongation after fracture (El) of 28% or more as measured by a tensile test according to JIS Z 2241.

Furthermore, the term "good ridging resistance" means that in the case where a single surface of a JIS No. 5 tensile specimen taken in accordance with JIS Z 2201 is polished with #600 emery paper, a prestrain of 20% is applied thereto by uniaxial stretching, and the center of a parallel portion of the tensile specimen is measured for waviness in accordance with JIS B 0601-2001, the large waviness (ridging height) is 2.5 μm or less.

Solution to Problem

As a result of performing investigations to solve the problems, the inventors have achieved findings below. First, the inventors have investigated factors causing the reduction in surface gloss of a steel sheet obtained by pickling and then cold-rolling an annealed hot rolled sheet containing a martensite phase. As a result, the inventors have found that the selective dissolution of grain boundaries occurs on surfaces of the steel sheet during pickling and this reduces the surface gloss of a cold rolled steel sheet.

FIG. 1 is an illustration showing a scanning electron microscope (SEM) image of a surface of a steel sheet manufactured under conditions below. Steel containing C: 0.015%, Si: 0.15%, Mn: 0.80%, P: 0.030%, S: 0.004%, Cr: 16.2%, Ni: 0.11%, Al: 0.003%, and N: 0.014% on a mass basis, the remainder being Fe and inevitable impurities, was hot rolled and a hot rolled sheet was annealed by holding at 900° C. for 1 minute (60 seconds) and was then cooled at a rate of 30° C./sec, whereby an annealed hot rolled sheet was obtained (No. 27 in Table 2 for examples below). The obtained annealed hot rolled sheet was shot-blasted and was descaled in such a manner that the annealed hot rolled sheet was immersed in a solution of 20% by mass sulfuric acid at a temperature of 80° C. for 60 seconds and was then immersed in an acid mixture solution composed of 15% by mass nitric acid and 3% by mass hydrofluoric acid at a temperature of 55° C. for 30 seconds, whereby a pickled steel sheet was obtained. The obtained pickled steel sheet was surface-observed using a backscattered electron image at an acceleration voltage of 15 kV using a SEM.

In FIG. 1, (a) shows a grain boundary where selective dissolution occurred and (b) shows a grain boundary where selective dissolution did not occur. Referring to FIG. 1, among crystal grain boundaries present in this FIGURE, grain boundaries having black and thick contrast are selectively dissolved. Selective dissolution dissolves with a width of 0.1 μm or more and remains in a surface portion of a cold rolled steel sheet in the form of flaws. Furthermore, selective dissolution causes the exfoliation of the surface portion during or after rolling. The flaws and surface exfoliation reduce the gloss of the cold rolled steel sheet.

The inventors have investigated methods for preventing the above phenomenon on the basis of the above results. As a result, the inventors have found that the selective dissolution of ferrite phase grain boundaries after pickling can be prevented in such a manner that various components (particularly C and N) are appropriately controlled and manufacturing conditions are appropriately controlled such that the volume fraction of a martensite phase in an annealed hot rolled sheet is 5% or more.

Subsequently, the inventors have investigated methods for increasing the ductility. As a result, the inventors have found that the ductility is increased in such a manner that various components (particularly C and N) are appropriately controlled and the volume fraction of a martensite phase present in a hot rolled sheet after annealing is adjusted to 20% or less.

Aspects of the present invention have been made on the basis of the above findings and are summarized below.

[1] A material for cold rolled stainless steel sheets contains C: 0.005% to 0.025%, Si: 0.02% to 0.50%, Mn: 0.55% to 1.0%, P: 0.040% or less, S: 0.01% or less, Cr: 15.5% to 18.0%, Ni: 0.01% to 1.0%, Al: 0.001% to 0.10%, and N: 0.005% to 0.025% on a mass basis, the remainder being Fe and inevitable impurities, and has a metallographic structure comprising 5% to 20% of a martensite phase in terms of volume fraction, the remainder being a ferrite phase. Furthermore, in the material, the proportion of selectively dissolved ferrite phase grain boundaries among ferrite phase grain boundaries exposed on a surface of a steel sheet is 20% or less of the total length of grain boundaries.

[2] The material for the cold rolled stainless steel sheets specified in Item [1] further contains one or more selected from Cu: 0.1% to 1.0%, Mo: 0.1% to 0.5%, and Co: 0.01% to 0.5% on a mass basis.

[3] The material for the cold rolled stainless steel sheets specified in Item [1] or [2] further contains one or more selected from V: 0.01% to 0.10%, Ti: 0.001% to 0.05%, Nb: 0.001% to 0.05%, Ca: 0.0002% to 0.0020%, Mg: 0.0002% to 0.0050%, B: 0.0002% to 0.0050%, and REM: 0.01% to 0.10% on a mass basis.

[4] A cold rolled ferritic stainless steel sheet is obtained by cold-rolling and annealing the material for the cold rolled stainless steel sheets specified in any one of Items [1] to [3].

[5] A method for manufacturing the material for the cold rolled stainless steel sheets specified in any one of Items [1] to [3] includes hot-rolling a steel slab, annealing a hot rolled sheet in such a manner that the hot rolled sheet is held in a temperature range from 920° C. to 1,100° C. for 5 seconds to 15 minutes, cooling the hot rolled sheet in a temperature range from 1,100° C. to 500° C. at a cooling rate of 10° C./sec or more, and pickling the hot rolled sheet. Incidentally, in the present specification, the unit "%" expressing each component of steel refers to mass percent. In accordance with aspects of the present invention, the term "selectively dissolved ferrite phase grain boundary" refers to a ferrite phase grain boundary, dissolved by pickling, having a dissolved ferrite phase grain boundary with a width of 0.1 μm or more.

Using a material for cold rolled stainless steel sheets according to aspects of the present invention enables a cold rolled ferritic stainless steel sheet having sufficient corrosion resistance, excellent surface texture, excellent formability, and excellent ridging resistance to be obtained and is industrially particularly advantageous.

BRIEF DESCRIPTION OF DRAWINGS

FIG. 1 is an illustration showing a scanning electron microscope image of a surface of a steel sheet.

DETAILED DESCRIPTION OF EMBODIMENTS OF THE INVENTION

Aspects of the present invention are described below in detail.

A material for cold rolled stainless steel sheets according to aspects of the present invention contains C: 0.005% to 0.025%, Si: 0.02% to 0.50%, Mn: 0.50% to 1.0%, P: 0.040% or less, S: 0.01% or less, Cr: 15.5% to 18.0%, Ni: 0.01% to 0.50%, Al: 0.001% to 0.10%, and N: 0.005% to 0.025% on a mass basis, the remainder being Fe and inevitable impurities, and has a metallographic structure containing 5% to 20% of a martensite phase in terms of volume fraction, the remainder being a ferrite phase. The proportion of selectively dissolved ferrite phase grain boundaries among ferrite phase grain boundaries exposed on a surface of a steel sheet is 20% or less of the total length of grain boundaries in the material.

The material for the cold rolled stainless steel sheets according to aspects of the present invention can be manufactured in such a manner that hot rolling is performed and a hot rolled sheet is annealed by holding the hot rolled sheet in a temperature range from 920° C. to 1,100° C. for 5 seconds to 15 minutes, is cooled in a temperature range from 1,100° C. to 500° C. at a cooling rate, of 10° C./sec or more, and is then pickled.

A cold rolled stainless steel sheet having sufficient corrosion resistance, excellent surface texture, excellent formability, and excellent ridging resistance can be obtained in such a manner that the material used for stainless cold-rolling according to aspects of the present invention is preferably cold rolled at a rolling reduction of 50% or more and a cold rolled sheet is annealed by holding the cold rolled sheet in a temperature range from 800° C. to 950° C. for 5 seconds to 15 minutes.

First, technical contents according to aspects of the present invention are described in detail.

The inventors have investigated the reason why the selective dissolution of ferrite phase grain boundaries occurs when an annealed hot rolled sheet containing a martensite phase is pickled. As a result, the inventors have found that the local reduction of Cr concentration (the local depletion of Cr) that occurs at the ferrite phase grain boundaries after the annealing of a hot rolled sheet is a cause of selective dissolution. In order to form the martensite phase after the annealing of the hot rolled sheet, the hot rolled sheet needs to be annealed at a high temperature of about 880° C. or higher, which corresponds to a two-phase temperature range of a ferrite phase and an austenite phase. In this temperature range, almost all C and N form solid solutions in steel. C and N, which once formed the solid solutions, precipitate mainly at the ferrite phase grain boundaries in the form of Cr carbonitrides during cooling after annealing; hence, the concentration of Cr near grain boundaries decreases in some cases. The depletion of the Cr has been a cause of the selective dissolution of the ferrite phase grain boundaries that occurs during pickling. Since the selective dissolution reaches a depth of 5 μm or more from a surface layer of a steel sheet, the selective dissolution not only remains in a surface portion in the form of flaws even if cold rolling is performed but also causes the exfoliation of the surface portion during or after rolling. Light incident on a surface of the steel sheet is diffusely reflected by the flaws and surface exfoliation, whereby the gloss of a cold rolled steel sheet is reduced.

As a result of investigations, the inventors have found that in the case where, among crystal grain boundaries (ferrite phase grain boundaries) exposed on a surface of a steel sheet, more than 20% of the total length of grain boundaries is selectively dissolved, the surface quality of a cold rolled steel sheet is deteriorated. However, when selectively dissolved grain boundaries are 20% or less of the total length, the distance between flaws is relatively large. Therefore, the exfoliation of a surface portion is unlikely to occur during or after rolling and diffuse reflection by the flaws is reduced; hence, no significant decrease in gloss is caused. Thus, in order to achieve good surface quality, the length of the selectively dissolved grain boundaries needs to be 20% or less of the total length of grain boundaries. In order to obtain a cold rolled steel sheet with more excellent surface quality, the length of the selectively dissolved grain boundaries is preferably 10% or less and more preferably 5% or less.

From the above, for the selective dissolution of grain boundaries on a surface of a steel sheet, in the material for the cold rolled stainless steel sheets according to the present invention, the proportion of selectively dissolved ferrite phase grain boundaries among ferrite phase grain boundaries exposed on the steel sheet surface is set to 20% or less of the total length of the grain boundaries. Incidentally, the proportion of the selectively dissolved ferrite phase grain boundaries can be measured and determined by a method described in an example below.

Next, the inventors have investigated methods for suppressing the selective dissolution of ferrite phase grain boundaries. In order to suppress the decrease in concentration of Cr at the ferrite phase grain boundaries, the precipitation of Cr carbonitrides at the ferrite phase grain boundaries after the annealing of a hot rolled sheet needs to be reduced. For this, the reduction in C concentration and N concentration of the ferrite phase is effective. However, even if the content of each of C and N in steel is simply reduced, the precipitation of the Cr carbonitrides at the ferrite phase grain boundaries has not been reduced when the C content and the N content are lower limits with industrially available refining. In addition, the following method is known as a method for suppressing the precipitation of the Cr carbonitrides: a method for fixing C and N in steel as precipitates by adding a stabilizing element such as Ti or Nb. However, elements such as Ti and Nb suppress the generation of an austenite phase during the annealing of a hot rolled sheet. Therefore, the effect of improving ridging resistance by producing the martensite phase that is one of features of aspects of the present invention is not obtained and increases in manufacturing costs due to the use of an expensive metal are caused.

Therefore, the inventors have devised the use of the austenite phase, which has larger C and N solid solubility limits than the ferrite phase, as a novel technique for preventing selective dissolution. In the annealing of a hot rolled sheet, the austenite phase is produced and C and N in steel are formed into solid solutions in the austenite phase in large amounts. Although the austenite phase, which is produced in the annealing of the hot rolled sheet, is transformed into the martensite phase by cooling, C and N remain fixed in the martensite phase. As a result, the concentration of each of C and N in the ferrite phase is reduced. As a result of investigations, the inventors have found that controlling steel components and the fraction of the martensite phase in the annealed hot rolled sheet in an appropriate balance reduces the amounts of C and N in the ferrite phase during the annealing of the hot rolled sheet, suppresses the precipitation of the Cr carbonitrides at the ferrite phase grain boundaries that occurs during cooling after the annealing of the hot rolled sheet, and reduces the selective dissolution of the ferrite phase grain boundaries during pickling.

In order to prevent the precipitation of the Cr carbonitrides at grain boundaries by the above method, the balance between the C content, the N content, and the amount of martensite (the amount of austenite at high temperature) is important. First, the preferable C content and the preferable N content are described. When one or both of the C content and the N content are more than 0.025%, large amounts of C and N remain in the ferrite phase even if C and N are formed into solid solutions in the austenite phase in large amounts by a method according to aspects of the present invention; hence, the precipitation of the Cr carbonitrides cannot be suppressed. On the other hand, C and N have the effect of promoting the generation of the austenite phase. Therefore, if one or both of the C content and the N content are reduced to less than 0.005%, then the martensite phase is hardly generated and the concentration of each of C and N in the ferrite phase is increased; hence, the precipitation of the Cr carbonitrides cannot be suppressed. Thus, the content of C and the content of N need to range from 0.005% to 0.025% respectively.

Next, the preferable amount of martensite is described. As a result of performing various investigations, the inventors have found that in the case where the content of C and the content of N are controlled within the range of 0.005% to 0.025%, the content of martensite that is necessary to suppress the precipitation of the Cr carbonitrides is 5% or more. When the content of martensite is less than 5%, the amounts of C and N that form solid solutions in the austenite phase during the annealing of the hot rolled sheet are insufficient. Therefore, large amounts of C and N remain in the ferrite phase and the precipitation of the Cr carbonitrides during cooling after the annealing of the hot rolled sheet cannot be prevented. On the other hand, it has become apparent that the excessive production of the martensite phase deteriorates the formability of a cold rolled sheet. When the content of martensite is more than 20%, large amounts of carbonitrides precipitate in a ferrite phase portion produced by the decomposition of the martensite phase to inhibit grain growth even if cold rolling and annealing are performed in a ferrite single-phase temperature range; hence, excellent elongation cannot be obtained. Furthermore, the annealed hot rolled sheet hardens to increase the rolling load, thereby reducing the manufacturing efficiency. Therefore, the volume fraction of the martensite phase is set to 5% to 20% and preferably ranges from 5% to 15%. The volume, fraction of the martensite phase depends on components (particularly, C, N, Si, Mn, Cr, Ni, and Cu) and the annealing temperature of the hot rolled sheet. Thus, in order to obtain the martensite phase with a desired volume fraction, components and the annealing temperature of the hot rolled sheet are controlled as described below. Incidentally, the volume fraction of the martensite phase can be measured by a method described in an example below.

As described above, controlling steel components (particularly, C and N) and the volume fraction of the martensite phase in an appropriate balance enables a SUS430 steel sheet having excellent surface quality, formability, and ridging resistance to be manufactured by a continuous annealing process excellent in productivity.

Next, the composition of the material for the cold rolled stainless steel sheets according to aspects of the present invention is described. Hereinafter, the unit "%" refers to mass percent unless otherwise specified.

C: 0.005% to 0.025%

C has the effect of promoting the generation of the austenite phase during the annealing of the hot rolled sheet to suppress the selective dissolution of the ferrite phase grain boundaries during pickling. Therefore, the content of C is set to 0.005% or more. However, the content of C is more than 0.025%, Cr carbides precipitate and the selective dissolution of the ferrite phase grain boundaries cannot be prevented even by a method according to aspects of the present invention. Thus, the content of C ranges from 0.005% to 0.025%. The lower limit thereof is preferably 0.008% and more preferably 0.010%. The upper limit thereof is preferably 0.020% and more preferably 0.015%.

Si: 0.02% to 0.50%

Si is an element acting as a deoxidizing agent during the production of steel. In order to obtain this effect, the content of Si needs to be 0.02% or more. However, Si suppresses the generation of the austenite phase. Therefore, when the content thereof is more than 0.50%, the generation of the austenite phase during the annealing of the hot rolled sheet is insufficient and the effect of suppressing the selective dissolution of the ferrite phase grain boundaries by the present invention is not obtained. Thus, the content of Si ranges from 0.02% to 0.50%. The content of Si preferably ranges from 0.10% to 0.35% and more preferably 0.10% to 0.30%.

Mn: 0.55% to 1.0%

Mn has the effect of promoting the generation of the austenite phase to suppress the selective dissolution of the ferrite phase grain boundaries during pickling. In order to obtain this effect, the content of Mn needs to be 0.55% or more. However, the content of Mn is more than 1.0%, the austenite phase is excessively produced during the annealing of the hot rolled sheet and an annealed cold rolled sheet hardens to reduce the formability. Furthermore, the production of MnS increases to reduce the corrosion resistance. Therefore, the content of Mn ranges from 0.55% to 1.0%. The content of Mn ranges from 0.60% to 0.90% and more preferably 0.75% to 0.85%.

P: 0.040% or Less

P is an element promoting the intergranular fracture by intergranular segregation and therefore is preferably low. The upper limit is set to 0.040%. The upper limit is preferably 0.030% or less.

S: 0.01% or Less

S is an element which is present in the form of sulfide inclusions such as MnS and which reduces the ductility, the corrosion resistance, and the like. In particular, when the content thereof is more than 0.01%, such negative influences occur significantly. Therefore, the content of S is preferably as low as possible. In accordance with aspects of the present invention, the upper limit of the content of S is set to 0.01%. The upper limit is preferably 0.007% or less and more preferably 0.005% or less.

Cr: 15.5% to 18.0%

Cr is an element having the effect of increasing the corrosion resistance by forming a passive film on a surface of a steel sheet. In order to obtain this effect, the content of Cr needs to be 15.5% or more. However, Cr suppresses the generation of the austenite phase. Therefore, when the content thereof is more than 18.0%, the generation of the austenite phase during the annealing of the hot rolled sheet is insufficient and the effect of suppressing the selective dissolution of the ferrite phase grain boundaries by the present invention is not obtained. Therefore, the content of Cr ranges from 15.5% to 18.0%. The content of Cr preferably ranges from 16.0% to 18.0% and more preferably 16.0% to 17.0%.

Ni: 0.01% to 1.0%

Ni is an element increasing the corrosion resistance and has the effect of promoting the generation of the austenite phase and the effect of expanding a two-phase temperature range in which the ferrite phase and the austenite phase appear. These effects become marked when the content of Ni is 0.01% or more. However, when the content of Ni is more than 1.0%, the workability deteriorates, which is not preferable. Therefore, when Ni is contained, the content thereof is set to 0.01% to 1.0%. The content thereof preferably ranges from 0.05% to 0.60% and more preferably 0.10% to 0.30%.

Al: 0.001% to 0.10%

Al, as well as Si, is an element acting as a deoxidizing agent. In order to obtain this effect, the content of Al needs to be 0.001% or more. However, Al suppresses the generation of the austenite phase. Therefore, when the content thereof is more than 0.10%, the generation of the austenite phase during the annealing of the hot rolled sheet is insufficient and the effect of suppressing the selective dissolution of the ferrite phase grain boundaries by the present invention is not obtained. Furthermore, Al inclusions such as $Al_2O_3$ increase and the surface quality is likely to deteriorate. Therefore, the content of Al ranges from 0.001% to 0.10%. The content of Al preferably ranges from 0.001% to 0.07%, more preferably 0.001% to 0.05%, and further more preferably 0.001% to 0.03%.

N: 0.005% to 0.025%

N has the effect of promoting the generation of the austenite phase during the annealing of the hot rolled sheet and the effect of suppressing the selective dissolution of the ferrite phase grain boundaries during pickling. Therefore, the content thereof is set to 0.005% or more. However, the content of N is more than 0.025%, Cr nitrides precipitate and the selective dissolution of the ferrite phase grain boundaries cannot be prevented by a method according to aspects of the present invention. Therefore, the content of N is set to 0.025% or less. Thus, the content of N ranges from 0.005% to 0.025%. The lower limit is preferably 0.008% and more preferably 0.010%. The upper limit is preferably 0.020% and more preferably 0.015%.

The remainder are Fe and the inevitable impurities.

Although effects of the present invention are obtained by the above components, elements below may be further contained for the purpose of improving productivity or material properties.

One or More Selected from Cu: 0.1% to 1.0%, Mo: 0.1% to 0.5%, and Co: 0.01% to 0.5%

Cu: 0.1% to 1.0%

Cu is an element increasing the corrosion resistance. In particular, in the case where high corrosion resistance is required, it is effective to contain Cu. Cu has the effect of promoting the generation of the austenite phase and the effect of expanding a two-phase temperature range in which the ferrite phase and the austenite phase appear during the annealing of the hot rolled sheet. These effects become marked when the content of Cu is 0.1% or more. However, when the content of Cu is more than 1.0%, the workability deteriorates, which is not preferable. Therefore, when Cu is contained, the content thereof is set to 0.1% to 1.0%. The content thereof preferably ranges from 0.2% to 0.8% and more preferably 0.3% to 0.5%.

Mo: 0.1% to 0.5%

Mo is an element increasing the corrosion resistance. In particular, in the case where high corrosion resistance is required, it is effective to contain Mo. This effect becomes marked when the content of Mo is 0.1% or more. However, Mo suppresses the generation of the austenite phase. Therefore, when the content thereof is more than 0.5%, the generation of the austenite phase during the annealing of the hot rolled sheet is insufficient and the effect of suppressing the selective dissolution of the ferrite phase grain boundaries by the present invention is not obtained. Therefore, when Mo is contained, the content thereof is set to 0.1% to 0.5%. The content thereof preferably ranges from 0.1% to 0.3%.

Co: 0.01% to 0.5%

Co is an element increasing the toughness. This effect is obtained when the content of Co is 0.01% or more. However, a Co content of more than 0.5% deteriorates the productivity. Therefore, when Co is contained, the content thereof ranges from 0.01% to 0.5%.

One or more selected from V: 0.01% to 0.10%, Ti: 0.001% to 0.05%, Nb: 0.001% to 0.05%, Ca: 0.0002% to 0.0020%, Mg: 0.0002% to 0.0050%, B: 0.0002% to 0.0050%, and REM: 0.01% to 0.10%

V: 0.01% to 0.10%

V reduces the amounts of solutes C and N by combining with C and N in steel. This enhances the workability. Furthermore, V controls the precipitate behavior of carbonitrides in the hot rolled sheet to suppress the occurrence of surface defects due to hot rolling or annealing, thereby improving the surface quality. In order to obtain these effects, the content of V needs to be 0.01% or more. However, V suppresses the generation of the austenite phase. Therefore, when the content thereof is more than 0.10%, the generation of the austenite phase during the annealing of the hot rolled sheet is insufficient and the effect of suppressing the selective dissolution of the ferrite phase grain boundaries by the present invention is not obtained. Therefore, when V is contained, the content thereof ranges from 0.01% to 0.10%. The content thereof preferably ranges from 0.02% to 0.08%.

Ti: 0.001% to 0.05%, Nb: 0.001% to 0.05%

Ti and Nb, as well as V, are elements having high affinity to C and N; precipitate during hot rolling in the form of carbides or nitrides; reduce the amounts of solutes C and N in a matrix; and improves the workability. In order to obtain these effects, 0.001% or more Ti or 0.001% or more Nb needs to be contained. However, Ti and Nb suppress the generation of the austenite phase. Therefore, when the content of each of Ti and Nb is more than 0.05%, the generation of the austenite phase during the annealing of the hot rolled sheet is insufficient and the effect of suppressing the selective dissolution of the ferrite phase grain boundaries by the present invention is not obtained. Furthermore, good surface quality cannot be obtained because of the excessive precipitation of TiN or NbC. Therefore, when Ti is contained, the content thereof ranges from 0.001% to 0.05%. When Nb is contained, the content thereof ranges from 0.001% to 0.05%. The content of Ti preferably ranges from 0.003% to 0.03% and more preferably 0.005% to 0.015%. The content of Nb preferably ranges from 0.003% to 0.03% and more preferably 0.005% to 0.015%.

Ca: 0.0002% to 0.0020%

Ca is a component effective in preventing the clogging of a nozzle due to the precipitation of Ti inclusions, the clogging being likely to occur during continuous casting. In order to obtain this effect, the content of Ca needs to be 0.0002% or more. However, when the content of Ca is more than 0.0020%, CaS is produced to reduce the corrosion resistance. Therefore, when Ca is contained, the content thereof ranges from 0.0002% to 0.0020%. The content thereof preferably ranges from 0.0005% to 0.0015% and more preferably 0.0005% to 0.0010%.

Mg: 0.0002% to 0.0050%

Mg is an element having the effect of improving the hot workability. In order to obtain this effect, the content of Mg needs to be 0.0002% or more. However, when the content of Mg is more than 0.0050%, the surface quality is deteriorated. Therefore, when Mg is contained, the content thereof ranges from 0.0002% to 0.0050%. The content thereof preferably ranges from 0.0005% to 0.0035% and more preferably 0.0005% to 0.0020%.

B: 0.0002% to 0.0050%

B is an element effective in preventing low-temperature secondary working embrittlement. In order to obtain this effect, the content of B needs to be 0.0002% or more. However, when the content of B is more than 0.0050%, the hot workability is deteriorated. Therefore, when B is contained, the content thereof ranges from 0.0002% to 0.0050%. The content thereof preferably ranges from 0.0005% to 0.0035% and more preferably 0.0005% to 0.0020%.

REM: 0.01% to 0.10%

REMs (rare-earth metals) are elements improving the oxidation resistance and particularly have the effect of improving the corrosion resistance of the weld by suppressing the formation of an oxide layer on a weld. In order to obtain this effect, the content of a REM needs to be 0.01% or more. However, containing more than 0.10% of the REM deteriorates the productivity, such as picklability, during cold rolling and annealing. Since the REM is an expensive element, excessively containing the REM causes increases in manufacturing costs and therefore is not preferable. Therefore, when the REM is contained, the content thereof ranges from 0.01% to 0.10%.

Next, a method for manufacturing the material used for stainless cold-rolling according to aspects of the present invention is described.

The material used for stainless cold-rolling according to aspects of the present invention is obtained in such a manner that a steel slab having the above composition is hot rolled and a hot rolled sheet is annealed in the temperature range from 920° C. to 1,100° C. for 5 seconds to 15 minutes, is cooled in the temperature range from 1,100° C. to 500° C. at a cooling rate of 10° C./sec or more, and is then pickled.

Molten steel having the above composition is produced by a known process such as a converter, an electric furnace, or a vacuum melting furnace and is formed into a steel material (slab) by a continuous casting process or an ingot casting-blooming process. The slab is heated at 1,100° C. to 1,250° C. for 1 hour to 24 hours and is then hot rolled into the hot rolled sheet. Alternatively, the as-cast slab is directly hot rolled into the hot rolled sheet without heating.

Next, the hot rolled sheet is annealed at 920° C. to 1,100° C., which corresponds to a two-phase temperature range of the ferrite phase and the austenite phase, for 5 seconds to 15 minutes.

Annealing of Hot Rolled Sheet at 920° C. to 1,100° C. for 5 Seconds to 15 Minutes The annealing of the hot rolled sheet is an important step to obtain a metallographic structure according to aspects of the present invention. When the annealing temperature of the hot rolled sheet is lower than 920° C., sufficient recrystallization does not occur and the metallographic structure is in a ferrite single-phase range so that an effect of the present invention that is induced by two-phase range annealing is not obtained. However, when the annealing temperature thereof is higher than 1,100° C., the generation of the austenite phase decreases and therefore an effect of the present invention is not obtained. When the annealing time is less than 5 seconds, predetermined formability is not obtained because the production of the austenite phase and the recrystallization of the ferrite phase do not occur sufficiently even if annealing is performed at a predetermined temperature. However, an annealing time of more than 15 minutes causes deterioration in productivity and is not preferable. Therefore, the hot rolled sheet is annealed at 920° C. to 1,100° C. within the range of 5 seconds to 15 minutes. The temperature range is preferably 940° C. to 1,100° C. and more preferably 960° C. to 1,100° C.

Next, cooling is performed in the temperature range from 1,100° C. to 500° C. at a cooling rate of 10° C./sec or more.

Cooling in Temperature Range from 1,100° C. to 500° C. at Cooling Rate of 10° C./Sec or More In order to prevent the selective dissolution of the ferrite phase grain boundaries, the precipitation of the Cr carbonitrides at the ferrite phase grain boundaries needs to be suppressed during cooling after the annealing of the hot rolled sheet. Therefore, it is preferable that the cooling rate in the precipitation temperature range of carbonitrides is increased and the hot rolled sheet is cooled to a temperature lower than the precipitation temperature range before the precipitation of the Cr carbonitrides occurs sufficiently. In order to obtain this effect, the hot rolled sheet is cooled in the temperature range from 1,100° C. to 500° C. at a cooling rate of 10° C./sec or more. The cooling rate is preferably 15° C./sec or more and more preferably 20° C./sec or more. In accordance with aspects of the present invention, the term "cooling rate" refers to the average cooling rate in the temperature range from 1,100° C. to 500° C.

Thereafter, shot blasting is performed as required and pickling is then performed for the purpose of descaling. In the case of performing pickling, the following method can be used: for example, a method in which after immersion is performed in a solution of 10% to 30% by mass sulfuric acid at a temperature of 50° C. to 100° C. for 15 seconds or more, immersion is performed in an acid mixture solution composed of 10% to 30% by mass nitric acid and 1% to 10% by mass hydrofluoric acid at a temperature of 30° C. to 80° C. for 10 seconds or more. Incidentally, descaling may be performed by surface grinding.

As described above, the material for the cold rolled stainless steel sheets according to aspects of the present invention is obtained.

Next, preferable conditions for manufacturing a cold rolled stainless steel sheet using the material for the cold rolled stainless steel sheets according to aspects of the present invention are described below.

For example, the material, obtained as described above, for the cold rolled stainless steel sheets is cold rolled at a rolling reduction of 50% or more and a cold rolled sheet is annealed in such a manner that the cold rolled sheet is held in the temperature range from 800° C. to 950° C. for 5 seconds to 15 minutes, whereby a cold rolled ferritic stainless steel sheet is manufactured. The cold rolled ferritic stainless steel sheet is pickled or surface-polished as required, whereby a product is obtained.

From the viewpoints of formability and shape correction by cold rolling, cold rolling is preferably performed at a rolling reduction of 50% or more. In accordance with aspects of the present invention, cold rolling and annealing may be repeated two or more times and stainless steel foil with a thickness of 200 μm or less may be manufactured by cold rolling.

In the annealing of the cold rolled sheet, the cold rolled sheet is held in the temperature range from 800° C. to 950° C. for 5 seconds to 15 minutes. In order to obtain good formability, the cold rolled sheet is preferably held at 800° C. to 950° C. In order to obtain a better gloss, BA annealing (bright annealing) may be performed.

In order to further improve the surface quality after cold rolling and working, grinding, polishing, or the like may be performed.

EXAMPLE 1

Aspects of the present invention are described below in detail with reference to examples.

Stainless steels each having a composition shown in Table 1 were produced in a 50 kg compact vacuum melting furnace. After ingots of the steels were heated at 1,150° C. for 1 h, the steel ingots were hot rolled into hot rolled sheets with a thickness of 4 mm. Next, after the hot rolled sheets were annealed and cooled under conditions shown in Table 2, surfaces thereof were shot-blasted and were pickled, whereby annealed hot rolled sheets (materials for cold rolled stainless steel sheets) were obtained. Incidentally, pickling was performed in such a manner that after the hot rolled sheets were immersed in a solution of 20% by mass sulfuric acid at a temperature of 80° C. for 60 seconds, the hot rolled sheets were immersed in an acid mixture solution composed of 15% by mass nitric acid and 3% by mass hydrofluoric acid at a temperature of 55° C. for 30 seconds.

Specimens were taken from the annealed hot rolled sheets (materials for cold rolled stainless steel sheets) obtained as described above and were evaluated as described below.

(1) Selective Dissolution of Ferrite Phase Grain Boundaries

A 200 μm×200 μm region was surface-observed with a SEM, whereby the degree of selective dissolution of ferrite phase grain boundaries was evaluated. A ferrite phase grain boundary having a dissolved ferrite phase grain boundary with a width of 0.1 μm or more was defined as a selectively dissolved grain boundary and was discriminated from a selectively undissolved grain boundary having a dissolved ferrite phase grain boundary with a width of less than 0.1 μm. Next, the sum of the lengths of all grain boundaries present in the region and the sum of the lengths of selectively dissolved grain boundaries were measured from a recorded microstructure photograph. The proportion of the length of the selectively dissolved grain boundaries in the length of all the grain boundaries was determined, less than 10% was a particularly excellent characteristic and was rated acceptable (◎A), 10% to 20% or less was rated acceptable (○B), and more than 20% was rated unacceptable (×C).

(2) Microstructure Observation

Cross-sectional microstructure observation was performed in such a manner that a cross section of each obtained specimen that was parallel to the rolling direction of the specimen was embedded in resin, was mirror-polished, and was corroded (etched) with a hydrochloric acid solution of picric acid and a through-thickness central portion was photographed in ten fields of view at 400× magnification. From obtained microstructure photographs, a martensite phase and a ferrite phase were discriminated and separated from each other from metallographic features. The area fraction of the martensite phase was measured using an image analyzer. The average of the ten fields of view was defined as the area fraction of the martensite phase in the annealed hot rolled sheet.

Furthermore, the obtained annealed hot rolled sheets (materials for cold rolled stainless steel sheets) were cold rolled into cold rolled sheets with a thickness of 1.0 mm. Next, after the cold rolled sheets were annealed under conditions shown in Table 2, the cold rolled sheets were descaled by electrolytic pickling in an 18% by mass aqueous solution of $Na_2SO_4$ at a water temperature of 80° C. under 25 C/dm$^2$ conditions and electrolytic pickling in a 10% by mass aqueous solution of $HNO_3$ at a water temperature of 50° C. under 30 C/dm$^2$ conditions, whereby annealed cold rolled sheets (cold rolled ferritic stainless steel sheets) were obtained. The obtained annealed cold rolled sheets (cold rolled ferritic stainless steel sheets) were evaluated as described below.

(3) Evaluation of Formability (Ductility)

A JIS No. 13B tensile specimen was taken from each of the annealed cold rolled sheets (cold rolled ferritic stainless steel sheets) in a direction perpendicular to the rolling direction thereof and was measured for elongation after fracture by tensile testing in accordance with JIS Z 2241. A elongation after fracture of 30% or more was a particularly excellent characteristic and was rated acceptable (◎A), a elongation after fracture of 28% to less than 30% was rated acceptable (○B), and a elongation after fracture of less than 28% was rated unacceptable (×C).

(4) Evaluation of Surface Quality

The surface roughness was measured in accordance with JIS B 0601. An arithmetic average roughness Ra of 0.02 μm or less was a particularly excellent characteristic and was rated acceptable (◎A), an arithmetic average roughness Ra of more than 0.02 μm to 0.03 μm was rated acceptable (○B), and an arithmetic average roughness Ra of more than 0.03 was rated unacceptable (×C).

(5) Evaluation of Ridging Resistance

A JIS No. 5 tensile specimen was taken from each of the annealed cold rolled sheets (cold rolled ferritic stainless steel sheets) in parallel to the rolling direction thereof. After a single surface of the specimen was polished with #600 emery paper and a prestrain of 20% was applied thereto by uniaxial stretching, the center of a parallel portion of the tensile specimen was measured for waviness in accordance with JIS B 0601-2001. A maximum waviness (ridging height) of 2.5 μm or less was rated acceptable (○B) and a maximum waviness (ridging height) of more than 2.5 μm was rated unacceptable (×C).

(6) Evaluation of Corrosion Resistance

A 60 mm×100 mm specimen was taken from each of the annealed pickled cold rolled sheets. After a surface of the specimen was polish-finished with #600 emery paper, an end surface portion of the specimen was sealed. The specimen was subjected to a cyclic salt spray test specified in JIS H 8502. The cyclic salt spray test was performed for eight cycles, where salt spraying (5% by mass NaCl, 35° C., spraying for 2 h), drying (60° C., 4 h, a relative humidity of 40%), and then wetting (50° C., 2 h, a relative humidity of 95% or more) were performed in one cycle. A surface of the specimen that was subjected to the cyclic salt spray test for eight cycles was photographed. The rusting area of the surface of the specimen was measured by image analysis. The rusting area fraction ((rusting area of specimen/total area of specimen)×100 [%]) was calculated from the ratio of the rusting area to the total area of the specimen. A rusting area fraction of 10% or less was a particularly excellent characteristic and was rated acceptable (◎A), a rusting area fraction of more than 10% to 25% was rated acceptable (○B), and a rusting area fraction of more than 25% was rated unacceptable (×C).

Evaluation results are shown in Table 2 together with the manufacturing conditions.

TABLE 1

| Steel | Composition (mass percent) | | | | | | | | | | |
|---|---|---|---|---|---|---|---|---|---|---|---|
| symbol | C | Si | Mn | P | S | Cr | Ni | Al | N | Others | Remarks |
| AA | 0.015 | 0.15 | 0.80 | 0.030 | 0.004 | 16.2 | 0.11 | 0.003 | 0.014 | — | Adequate steel |
| AB | 0.010 | 0.15 | 0.80 | 0.020 | 0.005 | 16.2 | 0.12 | 0.003 | 0.010 | — | Adequate steel |
| AC | 0.007 | 0.16 | 0.79 | 0.034 | 0.004 | 16.4 | 0.12 | 0.003 | 0.006 | — | Adequate steel |

TABLE 1-continued

| Steel symbol | Composition (mass percent) C | Si | Mn | P | S | Cr | Ni | Al | N | Others | Remarks |
|---|---|---|---|---|---|---|---|---|---|---|---|
| AD | 0.023 | 0.32 | 0.58 | 0.023 | 0.005 | 16.3 | 0.08 | 0.003 | 0.021 | — | Adequate steel |
| AE | 0.018 | 0.15 | 0.56 | 0.032 | 0.003 | 16.2 | 0.11 | 0.005 | 0.014 | V: 0.03 | Adequate steel |
| AF | 0.014 | 0.16 | 0.80 | 0.033 | 0.005 | 16.2 | 0.10 | 0.002 | 0.015 | Mo: 0.5 | Adequate steel |
| AG | 0.010 | 0.14 | 0.60 | 0.026 | 0.006 | 16.5 | 0.12 | 0.005 | 0.024 | Ti: 0.014, B: 0.0031 | Adequate steel |
| AH | 0.019 | 0.15 | 0.61 | 0.028 | 0.006 | 16.3 | 0.21 | 0.006 | 0.021 | V: 0.06, Ca: 0.0009 | Adequate steel |
| AI | 0.015 | 0.15 | 0.80 | 0.020 | 0.003 | 16.2 | 0.12 | 0.005 | 0.015 | Mg: 0.0023 | Adequate steel |
| AJ | 0.014 | 0.15 | 0.88 | 0.020 | 0.004 | 16.3 | 0.12 | 0.005 | 0.022 | REM: 0.02 | Adequate steel |
| AK | 0.015 | 0.15 | 0.84 | 0.031 | 0.005 | 16.7 | 0.13 | 0.024 | 0.016 | Cu: 0.3 | Adequate steel |
| AL | 0.023 | 0.42 | 0.81 | 0.029 | 0.002 | 16.4 | 0.10 | 0.004 | 0.023 | Nb: 0.015 | Adequate steel |
| AM | 0.018 | 0.41 | 0.83 | 0.034 | 0.003 | 16.4 | 0.09 | 0.003 | 0.015 | Co: 0.4 | Adequate steel |
| BA | 0.003 | 0.03 | 0.51 | 0.020 | 0.004 | 16.2 | 0.15 | 0.004 | 0.011 | — | Comparative steel |
| BB | 0.010 | 0.04 | 0.52 | 0.020 | 0.004 | 16.2 | 0.15 | 0.004 | 0.002 | — | Comparative steel |
| BC | 0.028 | 0.31 | 0.79 | 0.031 | 0.006 | 16.1 | 0.12 | 0.003 | 0.022 | — | Comparative steel |
| BD | 0.020 | 0.31 | 0.79 | 0.031 | 0.006 | 16.1 | 0.12 | 0.003 | 0.027 | — | Comparative steel |
| BE | 0.022 | 1.13 | 0.81 | 0.028 | 0.004 | 16.2 | 0.10 | 0.003 | 0.021 | — | Comparative steel |
| BF | 0.022 | 0.15 | 1.07 | 0.031 | 0.004 | 16.1 | 0.15 | 0.003 | 0.023 | — | Comparative steel |
| BG | 0.022 | 0.31 | 0.58 | 0.032 | 0.003 | 15.3 | 0.10 | 0.003 | 0.019 | — | Comparative steel |
| BH | 0.024 | 0.15 | 0.61 | 0.028 | 0.005 | 18.4 | 0.15 | 0.004 | 0.022 | — | Comparative steel |
| BI | 0.022 | 0.31 | 0.19 | 0.031 | 0.005 | 16.1 | 0.12 | 0.004 | 0.035 | — | Comparative steel |

Note:
Underlined values are outside the scope of the present invention.

TABLE 2

| No. | Steel symbol | Conditions for annealing hot rolled sheet: Holding temperature (° C.) | Holding time (seconds) | Cooling rate (° C./sec) | Volume fraction of martensite phase (%) | Proportion of selectively dissolved grain boundaries (%) | Conditions for annealing cold rolled sheet: Holding temperature (° C.) | Holding time (seconds) |
|---|---|---|---|---|---|---|---|---|
| 1 | AA | 920 | 60 | 30 | 9 | 16 | 840 | 60 |
| 2 | | 980 | 60 | 30 | 11 | 4 | 840 | 60 |
| 3 | | 980 | 60 | 30 | 12 | 4 | 860 | 60 |
| 4 | | 1020 | 60 | 30 | 15 | 2 | 840 | 60 |
| 5 | AB | 980 | 60 | 30 | 10 | 2 | 840 | 60 |
| 6 | AC | 980 | 60 | 30 | 7 | <1 | 840 | 60 |
| 7 | AD | 980 | 60 | 30 | 8 | 11 | 840 | 60 |
| 8 | AE | 980 | 60 | 30 | 12 | 4 | 840 | 60 |
| 9 | AF | 980 | 60 | 30 | 14 | 9 | 840 | 60 |
| 10 | AG | 980 | 60 | 30 | 19 | <1 | 840 | 60 |
| 11 | AH | 980 | 60 | 30 | 20 | <1 | 840 | 60 |
| 12 | AI | 980 | 60 | 30 | 14 | 2 | 840 | 60 |
| 13 | AJ | 980 | 60 | 30 | 19 | 3 | 840 | 60 |
| 14 | AK | 980 | 60 | 30 | 13 | 3 | 840 | 60 |
| 15 | AL | 980 | 60 | 30 | 8 | 5 | 840 | 60 |
| 16 | AM | 980 | 60 | 30 | 8 | 4 | 840 | 60 |
| 17 | BA | 980 | 60 | 30 | 3 | 67 | 840 | 60 |
| 18 | BB | 980 | 60 | 30 | 2 | 54 | 840 | 60 |
| 19 | BC | 980 | 60 | 30 | 24 | 36 | 840 | 60 |
| 20 | BD | 980 | 60 | 30 | 28 | 44 | 840 | 60 |
| 21 | BE | 980 | 60 | 30 | 0 | 83 | 840 | 60 |
| 22 | BF | 980 | 60 | 30 | 31 | <1 | 840 | 60 |
| 23 | BG | 980 | 60 | 30 | 28 | <1 | 840 | 60 |
| 24 | BH | 980 | 60 | 30 | 3 | 54 | 840 | 60 |
| 25 | BI | 980 | 60 | 30 | 19 | 70 | 840 | 60 |
| 26 | AA | 800 | 30000 | 30 | 0 | <1 | 840 | 60 |
| 27 | | 900 | 60 | 30 | 0 | 76 | 840 | 60 |
| 28 | AD | 980 | 60 | 5 | 7 | 37 | 840 | 60 |

| No. | Elongation after fracture | Surface quality | Ridging resistance | Corrosion resistance | Remarks |
|---|---|---|---|---|---|
| 1 | ◎A | ○B | ○B | ◎A | Inventive example |
| 2 | ◎A | ◎A | ○B | ◎A | Inventive example |
| 3 | ◎A | ◎A | ○B | ◎A | Inventive example |
| 4 | ○B | ◎A | ○B | ◎A | Inventive example |
| 5 | ◎A | ◎A | ○B | ◎A | Inventive example |
| 6 | ◎A | ◎A | ○B | ◎A | Inventive example |
| 7 | ○B | ○B | ○B | ◎A | Inventive example |

TABLE 2-continued

| | | | | | |
|---|---|---|---|---|---|
| 8 | ◎A | ◎A | ○B | ◎A | Inventive example |
| 9 | ◎A | ◎A | ○B | ◎A | Inventive example |
| 10 | ○B | ◎A | ○B | ◎A | Inventive example |
| 11 | ○B | ◎A | ○B | ◎A | Inventive example |
| 12 | ◎A | ◎A | ○B | ◎A | Inventive example |
| 13 | ○B | ◎A | ○B | ◎A | Inventive example |
| 14 | ◎A | ◎A | ○B | ◎A | Inventive example |
| 15 | ◎A | ◎A | ○B | ◎A | Inventive example |
| 16 | ◎A | ◎A | ○B | ◎A | Inventive example |
| 17 | ◎A | ×C | ×C | ◎A | Comparative example |
| 18 | ◎A | ×C | ×C | ◎A | Comparative example |
| 19 | ×C | ×C | ○B | ○B | Comparative example |
| 20 | ×C | ×C | ○B | ○B | Comparative example |
| 21 | ◎A | ×C | ×C | ◎A | Comparative example |
| 22 | ×C | ◎A | ○B | ×C | Comparative example |
| 23 | ○B | ◎A | ○B | ×C | Comparative example |
| 24 | ◎A | ×C | ×C | ◎A | Comparative example |
| 25 | ○B | ×C | ○B | ◎A | Comparative example |
| 26 | ◎A | ◎A | ×C | ◎A | Comparative example |
| 27 | ◎A | ×C | ×C | ◎A | Comparative example |
| 28 | ○B | ×C | ○B | ◎A | Comparative example |

Note:
Underlined values are outside the scope of the present invention.

As is clear from Table 2, inventive examples are excellent in elongation after fracture, surface quality, ridging resistance, and corrosion resistance.

However, comparative examples (Steel Symbols BA to BH) have a composition outside the scope of the present invention and are inferior in one or more of elongation after fracture, surface quality, ridging resistance, and corrosion resistance to the inventive examples.

In particular, in Comparative Steels BA and BB, it is clear that the volume fraction of a martensite phase is small, the proportion of selectively dissolved grain boundaries is large, and the surface quality and the ridging resistance are poor as shown in Nos. 17 and 18 in Table 2 because C and N, respectively, are below the lower limit of the scope of the present invention.

In Comparative Steels BC and BD, it is clear that the volume fraction of a martensite phase is large, the proportion of selectively dissolved grain boundaries is large, and the elongation after fracture and the surface quality are poor as shown in Nos. 19 and 20 in Table 2 because C and N, respectively, are above the upper limit of the scope of the present invention.

In Comparative Steel BE, it is clear that the volume fraction of a martensite phase is small, the proportion of selectively dissolved grain boundaries is large, and the surface quality and the ridging resistance are poor as shown in No. 21 in Table 2 because Si is above the upper limit of the scope of the present invention.

In Comparative Steel BF, it is clear that the volume fraction of a martensite phase is large and the elongation after fracture and the corrosion resistance are poor as shown in No. 22 in Table 2 because Mn is above the upper limit of the scope of the present invention.

In Comparative Steel BG, it is clear that the volume fraction of a martensite phase is large and the corrosion resistance is poor as shown in No. 23 in Table 2 because Cr is below the lower limit of the scope of the present invention.

In Comparative Steel BH, it is clear that the volume fraction of a martensite phase is small, the proportion of selectively dissolved grain boundaries is large, and the surface quality and the ridging resistance are poor as shown in No. 24 in Table 2 because Cr is above the upper limit of the scope of the present invention.

In Comparative Steel BI, it is clear that the proportion of selectively dissolved grain boundaries is large and the surface quality is poor as shown in No. 25 in Table 2 because Mn is below the lower limit of the present invention and N is above the upper limit of the present invention.

It is clear that comparative examples (Nos. 26 to 28) in which components satisfy the scope of aspects of the present invention and conditions for annealing each hot rolled sheet or cooling conditions are outside the scope of the present invention are inferior in one or more of surface quality and ridging resistance to the inventive examples.

In particular, in No. 26 in Table 2, it is clear that the volume fraction of a martensite phase is small and the ridging resistance is poor because the holding temperature and holding time of the hot rolled sheet during annealing are outside the scope of the present invention.

In No. 27 in Table 2, it is clear that the volume fraction of a martensite phase is small, the proportion of selectively dissolved grain boundaries is large, and the surface quality and the ridging resistance are poor because the holding temperature of the hot rolled sheet during annealing is outside the scope of the present invention.

In No. 28 in Table 2, it is clear that the proportion of selectively dissolved grain boundaries is large and the surface quality is poor because the cooling rate after the annealing of the hot rolled sheet is outside the scope of the present invention.

From the above, it has been confirmed that a cold rolled ferritic stainless steel sheet having sufficient corrosion resistance, excellent surface quality, excellent formability, and excellent ridging resistance is readily obtained by using a material used for stainless cold-rolling according to aspects of the present invention.

INDUSTRIAL APPLICABILITY

A material for cold rolled stainless steel sheets obtained in accordance with aspects of the present invention is suitable as a material for press moldings, applications requiring high surface beautifulness, and SUS430 stainless steels (cold rolled ferritic stainless steel sheets) used for, for example, kitchen tools or tableware.

The invention claimed is:

1. A material for cold rolled stainless steel sheets, comprising C: 0.005% to 0.025%, Si: 0.02% to 0.50%, Mn: 0.55% to 1.0%, P: 0.040% or less, 5: 0.01% or less, Cr: 15.5% to 18.0%, Ni: 0.01% to 0.30%, Al: 0.001% to 0.07%, and N: 0.005% to 0.025% on a mass basis, the remainder being Fe and inevitable impurities, the material having a metallographic structure containing 5% to 20% of a martensite phase in terms of volume fraction, the remainder being a ferrite phase, wherein the proportion of selectively dissolved ferrite phase grain boundaries among ferrite phase grain boundaries exposed on a surface of a steel sheet formed by the material for the cold rolled stainless steel sheets is 20% or less of the total length of grain boundaries.

2. The material for the cold rolled stainless steel sheets according to claim 1, further containing one or more selected from Cu: 0.1% to 1.0%, Mo: 0.1% to 0.5%, and Co: 0.01% to 0.5% on a mass basis.

3. The material for the cold rolled stainless steel sheets according to claim 1, further containing one or more selected from V: 0.01% to 0.10%, Ti: 0.001% to 0.05%, Nb: 0.001% to 0.05%, Ca: 0.0002% to 0.0020%, Mg: 0.0002% to 0.0050%, 6: 0.0002% to 0.0050%, and REM: 0.01% to 0.10% on a mass basis.

4. The m material for the cold roiled stainless steel sheets according to claim 2, further containing one or more selected from V: 0.01% to 0.10%, Ti: 0.001% to 0.05%, Nb: 0.001% to 0.05%, Ca: 0.0002% to 0.0020%, Mg: 0.0002% to 0.0050%, 8: 0.0002% to 0.0050% and REM: 0.01% to 0.10% on a mass basis.

5. A cold rolled ferritic stainless steel sheet obtained by cold-rolling and annealing the material for the cold rolled stainless steel sheets according to claim 1.

6. A cold rolled ferritic stainless steel sheet obtained by cold-rolling and annealing the material for the cold rolled stainless steel sheets according to claim 2.

7. A cold rolled ferritic stainless steel sheet obtained by cold-rolling and annealing the material for the cold rolled stainless steel sheets according to claim 3.

8. A cold rolled ferritic stainless steel sheet obtained by cold-rolling and annealing the material for the cold rolled stainless steel sheets according to claim 4.

9. A method for manufacturing the material for the cold rolled stainless steel sheets according to claim 1, comprising hot rolling a steel slab to form a hot rolled sheet, annealing the hot rolled sheet in such a manner that the hot rolled sheet is held in a temperature range from 920° C. to 1,100° C. for 5 seconds to 15 minutes, cooling the hot rolled sheet in a temperature range from 1,100° C. to 500° C. at a cooling rate of 10° C./sec or more, and pickling the hot rolled sheet.

10. A method for manufacturing the material for the cold rolled stainless steel sheets according to claim 2, comprising hot rolling a steel slab to form a hot rolled sheet, annealing the hot rolled sheet in such a manner that the hot rolled sheet is held in a temperature range from 920° C. to 1,100° C. for 5 seconds to 15 minutes, cooling the hot rolled sheet in a temperature range from 1,100° C. to 500° C. at a cooling rate of 10° C./sec or more, and pickling the hot rolled sheet.

11. A method for manufacturing the material for the cold rolled stainless steel sheets according to claim 3, comprising hot rolling a steel slab to form a hot rolled sheet, annealing the hot rolled sheet in such a manner that the hot rolled sheet is held in a temperature range from 920° C. to 1,100° C. for 5 seconds to 15 minutes, cooling the hot rolled sheet in a temperature range from 1,100° C. to 500° C. at a cooling rate of 10° C./sec or more, and pickling the hot rolled sheet.

12. A method for manufacturing the material for the cold rolled stainless steel sheets according to claim 4, comprising hot rolling a steel slab to form a hot rolled sheet, annealing the hot rolled sheet in such a manner that the hot rolled sheet is held in a temperature range from 920° C. to 1,100° C. for 5 seconds to 15 minutes, cooling the hot rolled sheet in a temperature range from 1,100° C. to 500° C. at a cooling rate of 10° C./sec or more, and pickling the hot rolled sheet.

* * * * *